US008466853B2

(12) United States Patent
Song et al.

(10) Patent No.: US 8,466,853 B2
(45) Date of Patent: Jun. 18, 2013

(54) PLASMA DISPLAY DEVICE AND DRIVING METHOD THEREOF

(75) Inventors: Tae-Yong Song, Yongin-si (KR); Suk-Jae Park, Yongin-si (KR); Woo-Joon Chung, Yongin-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 354 days.

(21) Appl. No.: 12/814,284

(22) Filed: Jun. 11, 2010

(65) Prior Publication Data

US 2010/0315409 A1 Dec. 16, 2010

(30) Foreign Application Priority Data

Jun. 12, 2009 (KR) ..... 10-2009-0052503

(51) Int. Cl.
*G09G 5/00* (2006.01)

(52) U.S. Cl.
USPC ..... 345/60; 345/61; 345/62; 345/63; 345/64; 345/65; 345/66; 345/67; 345/68; 345/69; 345/70; 345/71; 345/72; 345/204; 345/690; 315/169.4

(58) Field of Classification Search
USPC ..... 345/60–72, 204, 690; 315/169.4
See application file for complete search history.

(56) References Cited

U.S. PATENT DOCUMENTS

| | | | | |
|---|---|---|---|---|
| 6,091,030 | A | 7/2000 | Tagawa et al. | |
| 2001/0017612 | A1 | 8/2001 | Holtslag et al. | |
| 2007/0075927 | A1* | 4/2007 | Moon | 345/63 |
| 2007/0262924 | A1* | 11/2007 | Kim | 345/67 |
| 2008/0204441 | A1* | 8/2008 | Song | 345/211 |

FOREIGN PATENT DOCUMENTS

| | | | |
|---|---|---|---|
| JP | 08-115057 | A | 5/1996 |
| JP | 10-143323 | A | 5/1998 |
| JP | 2001-318765 | A | 11/2001 |
| JP | 2003521749 | T | 7/2003 |
| KR | 1020060086771 | A | 8/2006 |
| KR | 10-2009-0121682 | A | 11/2009 |
| WO | WO 01/57834 | A1 | 8/2001 |

OTHER PUBLICATIONS

KIPO Notice of Allowance dated Nov. 23, 2010, for Korean priority Patent application 10-2009-0052503.
Patent Abstracts of Japan and English machine translation of Japanese Publication No. 08-115057 listed above, May 7, 1996.
Patent Abstracts of Japan and English machine translation of Japanese Publication No. 2001-318765 listed above, Nov. 16, 2001.

* cited by examiner

*Primary Examiner* — Alexander S Beck
*Assistant Examiner* — Jeffrey Steinberg
(74) *Attorney, Agent, or Firm* — Christie, Parker & Hale, LLP

(57) ABSTRACT

A driving method of a plasma display device according to an exemplary embodiment groups a plurality of address electrodes extending in a first direction into a plurality of groups, and logically divides each of the groups into a plurality of sub-groups. During a first period, a first pulse is sequentially applied to the plurality of groups, and a second pulse is sequentially applied to the plurality of sub-groups included in at least one of the plurality of groups during a second period following the first period. The first and second periods are address periods for sensing in a second direction crossing the first direction.

18 Claims, 10 Drawing Sheets

PLASMA DISPLAY DEVICE AND DRIVING METHOD THEREOF

CROSS-REFERENCE TO RELATED APPLICATION

This application claims priority to and the benefit of Korean Patent Application No. 10-2009-0052503, filed in the Korean Intellectual Property Office on Jun. 12, 2009, the entire content of which is incorporated herein by reference.

BACKGROUND

1. Field

The described technology relates generally to a plasma display device and a driving method thereof. More particularly, the described technology relates generally to a plasma display device having a contact sensing function and a driving method thereof.

2. Description of the Related Art

A plasma display device is a display device including a plasma display panel (PDP) for displaying characters or images by using plasma generated by gas discharge.

The plasma display device divides one frame (field) into a plurality of subfields, and is driven in the plurality of subfields for displaying images. Each subfield has a luminance weight value and includes an address period and a sustain period. The plasma display device selects discharge cells (hereinafter referred to as on-cells) to be turned on and discharge cells (hereinafter referred to as off-cells) not to be turned on during an address period, and performs a sustain discharge with the on-cells a number of times that corresponds to a luminance weight value of the corresponding subfield during the sustain period.

The plasma display device can sense a user's contact and process it. For realization of the contact sensing function, an infrared ray source is added inside the plasma display device, and an external sensor senses infrared rays emitted from the infrared ray source. In order to sense the user's contact, the PDP is scanned in the X-axis and Y-axis directions (refer to coordinates shown in FIG. 1), and a location of a point that emits the infrared rays may be recognized through an address electrode driving operation. An aspect in the address electrode driving of the plasma display device having the contact sensing function is to recognize an accurate contact point. In addition, as the operational speed (frequency) of the plasma display device becomes faster, the time available for contact sensing is reduced.

SUMMARY

Aspects of embodiments of the present invention are directed toward a driving method of a plasma display device having a contact sensing function, and a plasma display device using the same.

According to an embodiment of the present invention, a driving method of a plasma display device including a plurality of address electrodes extending in a first direction is provided. The method includes: grouping the plurality of address electrodes into a plurality of groups; logically dividing each of the plurality of groups into a plurality of sub-groups; during a first period, sequentially applying a first pulse to the plurality of groups; and during a second period following the first period, sequentially applying a second pulse to the plurality of sub-groups included in at least one of the plurality of groups. The first and second periods are address periods for sensing in a second direction crossing the first direction.

The sequential applying of the first pulse may include concurrently applying the first pulse to the plurality of sub-groups included in at least one of the plurality of groups.

The sequential applying of the second pulse may include sequentially applying the second pulse to the plurality of sub-groups included in each of the plurality of groups.

The sequential applying of the second pulse may include concurrently applying the second pulse to one of the sub-groups included in a first group and one of the sub-groups included in a second group from among the plurality of groups.

The k-th sub-group of each of the plurality of groups may be applied with the second pulse applied at the k-th time, wherein k is an integer that is greater than 1 and less than the number of plurality of sub-groups.

The driving method may further include determining a group that corresponds to a contact location among the plurality of groups from light generated during the first period, and the sequential applying of the second pulse may include sequentially applying the second pulse to the plurality of sub-groups included in the group corresponding to the contact location.

The plasma display device may further include a plurality of scan electrodes extending in the second direction, and the driving method may further include sequentially applying a third pulse to the plurality of scan electrodes during a third period that precedes the first period, and the third period is a vertical address period for sensing.

The driving method may further include determining a contact location in the first direction from light generated during the first period and light generated during the second period; and determining the contact location in the second direction from light generated during the third period.

According to another exemplary embodiment of the present invention, a driving method of a plasma display device is provided. The plasma display device includes a plurality of address electrodes extending in a first direction and a plurality of scan electrodes extending in a second direction that crosses the first direction. The driving method includes: grouping the plurality of address electrodes into a plurality of groups; logically dividing each of the plurality of groups into a plurality of sub-groups; during a first period, sequentially applying a first pulse to the plurality of scan electrodes; during a second period following the first period, sequentially applying a second pulse to the plurality of groups; during a third period following the second period, sequentially applying a third pulse to the plurality of sub-groups included in at least one of the plurality of groups; sensing light generated during the first, second, and third periods through an optical sensor; determining a location of the optical sensor in the first direction from the light sensed during the first period; and determining a location of the optical sensor in the second direction in the second period from a combination of the light sensed during the second period and the light sensed during the third period. In addition, the first period is a vertical address period for sensing, and the second and third periods are horizontal address periods for sensing.

A plasma display device according to another exemplary embodiment of the present invention includes: a plurality of address electrodes extending in a first direction; a controller for grouping the plurality of address electrodes into a plurality of groups and dividing each of the plurality of groups into a plurality of sub-groups; and a first driver for sequentially applying a first pulse by a group unit to the plurality of groups during a first period and sequentially applying a second pulse by a sub-group unit to a plurality of sub-groups included in at least one of the plurality of groups during a second period following the first period in response to a control signal of the controller. The first and second periods are horizontal address periods for sensing.

The plasma display device may further include a plurality of scan electrodes extending in a second direction that crosses the first direction and a second driver for sequentially applying a third pulse to the plurality of scan electrodes during a third period preceding the first period in response to the control signal of the controller. The third period is a vertical address period for sensing The controller may be configured to determine a contact location in the second direction from light generated during the first period and light generated during the second period, and to determine the contact location in the first direction from light generated during the third period.

The second driver may be configured to sequentially apply a fourth pulse to the plurality of scan electrodes during a fourth period following the third period, and the first driver may be configured to apply a fifth pulse to a discharge cell to be selected from a plurality of discharge cells defined by scan electrodes to which the fourth pulse is applied among the plurality of scan electrode and the plurality of address electrodes.

The controller may be configured to shift a start point of each of the plurality of groups by an offset interval, the first driver may be configured to sequentially apply a third pulse to the plurality of groups during a third period and a fourth pulse to a plurality of sub-groups included in each of the plurality groups during a fourth period, and the offset interval corresponds to at least one address electrode.

The controller may be configured to sense a contact location in the second direction by using lights generated during the first and second periods, to determine whether or not a sensing error occurred, and to control to perform the third and fourth periods when the sensing error occurred.

The driving methods according to the exemplary embodiments can prevent a decrease of address light output as the horizontal address electrode driving operation progresses. Accordingly, a plasma display device having a contact sensing function can accurately and promptly recognize a location of a contact point. In addition, decrease of address light according to progress of horizontal address electrode driving operation can be prevented, and when address electrodes are grouped and then address electrode driving operation are performed, coordinate recognition errors that may occur in boundaries between groups can be prevented.

DETAILED DESCRIPTION

Embodiments of the present invention will be described more fully hereinafter, in which exemplary embodiments are shown. This disclosure may, however, be embodied in many different forms and is not be construed as limited to the exemplary embodiments set forth herein.

In addition, unless explicitly described to the contrary, the word "comprise" and variations such as "comprises" or "comprising" will be understood to imply the inclusion of stated elements but not the exclusion of any other elements.

A plasma display device and a driving method thereof according to an exemplary embodiment will now be described in further detail with reference to the drawings.

Figure 1:
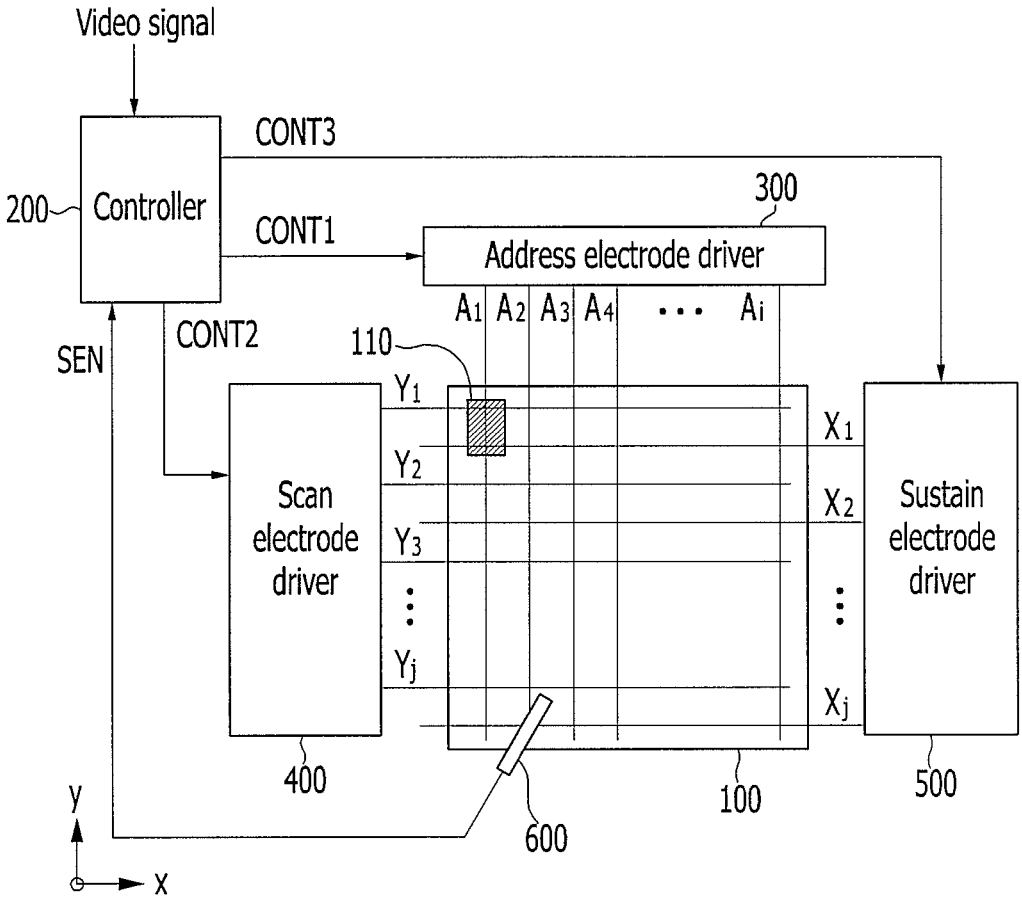
FIG. 1 is a block diagram of a plasma display device according to an exemplary embodiment.

FIG. 1 is a block diagram of a plasma display device according to an exemplary embodiment.

Referring to FIG. 1, a plasma display device includes a plasma display panel (PDP) 100, a controller 200, an address electrode driver 300, a scan electrode driver 400, a sustain electrode driver 500, and an optical sensor 600.

The PDP 100 includes a plurality of display electrodes Y1 to Yj and X1 to Xj, a plurality of address electrodes (hereinafter referred to as A electrodes) A1 to Ai, and a plurality of discharge cells 110.

The plurality of display electrodes Y1 to Yj and X1 to Xj include a plurality of scan electrodes (hereinafter referred to as Y electrodes) Y1 to Yj and a plurality of sustain electrodes (hereinafter referred to as X electrodes) X1 to Xj. The Y electrodes Y1 to Yj and the X electrodes X1 to Xj extend substantially in parallel with each other in a row direction (i.e., X-axis direction), and the A electrodes A1 to Ai extend substantially in parallel with each other in a column direction (i.e., Y-axis direction). The Y electrodes Y1 to Yj and the X electrodes X1 to Xj may respectively correspond to each other, one Y electrode may correspond to two X electrodes, or one X electrode may correspond to two Y electrodes. In this case, discharge cells 110 are formed in spaces located at the crossing regions of the A electrodes A1 to Ai, the Y electrodes Y1 to Yj, and the X electrodes X1 to Xj.

FIG. 1 shows an exemplary structure of the PDP 100, and panels of other structures can be used.

The optical sensor 600 is wirelessly or wire connected to the controller 200, and when light generated from the PDP is sensed, the optical sensor 600 transmits a sensing signal SEN to the controller 200. The optical sensor 600 includes a light receiving element for sensing light, and a photodiode or a phototransistor may be used as the light receiving element. Alternatively, an external computer may receive and process the sensing signal SEN from the optical sensor 600 and then transmit the processed sensing signal to the controller 200.

The controller 200 receives a video signal and the sensing signal SEN. The video signal may include luminance information of each discharge cell 110, and luminance of each discharge cell 110 may be expressed by one of a predetermined number of grays or gray levels.

The controller 200 divides one frame (i.e., field) into a plurality of subfields. In a plasma display device having a contact sensing function, one field may be divided into a subfield period for sensing and a subfield period for image displaying. Here, the sensing subfield period and image displaying subfield period may be respectively divided into a plurality of subfields. Each of a plurality of image displaying subfields provided in each of the image displaying subfield periods has a corresponding luminance weight value. For example, when eight image displaying subfields are provided in the image displaying subfield period, weight values of the eight image displaying subfields may respectively be 1, 2, 4, 8, 16, 32, 64, and 128. Therefore, a plasma display device having eight image displaying subfields may express gray levels of 0 to 255.

The controller 200 processes the sensing signal SEN during a period corresponding to a sensing subfield to determine a location (i.e., coordinate) of a discharge cell 110 where the optical sensor 600 senses light on the PDP 100.

The controller 200 processes the video signal to be appropriate for the plurality of image displaying subfields to generate an A electrode driving control signal CONT1, a Y electrode driving control signal CONT2, and an X electrode driving control signal CONT3. In addition, the controller 200 generates an A electrode driving control signal CONT1, a Y electrode driving control signal CONT2, and an X electrode driving control signal CONT3 for contact sensing in the sensing subfield SF0. The controller 200 outputs the A electrode driving control signal CONT1 to the address electrode driver 300, outputs the Y electrode driving control signal CONT2 to the scan electrode driver 400, and outputs the X electrode driving control signal CONT3 to the sustain electrode driver 500.

In the plurality of image displaying subfields, the address electrode driver 300 applies a driving voltage to the A electrodes A1 to Ai according to the A electrode driving control signal CONT1, the scan electrode driver 400 applies a driving voltage to the Y electrodes Y1 to Yj according to the Y electrode driving control signal CONT2, and the sustain electrode driver 500 applies a driving voltage to the X electrodes X1 to Xj according to the X electrode driving control signal CONT3.

When the driving voltages are respectively applied to the A, X, and Y electrodes, a discharge cell 110 that may emit light according to the application of the driving voltages emits light through a discharge operation.

Figure 2:
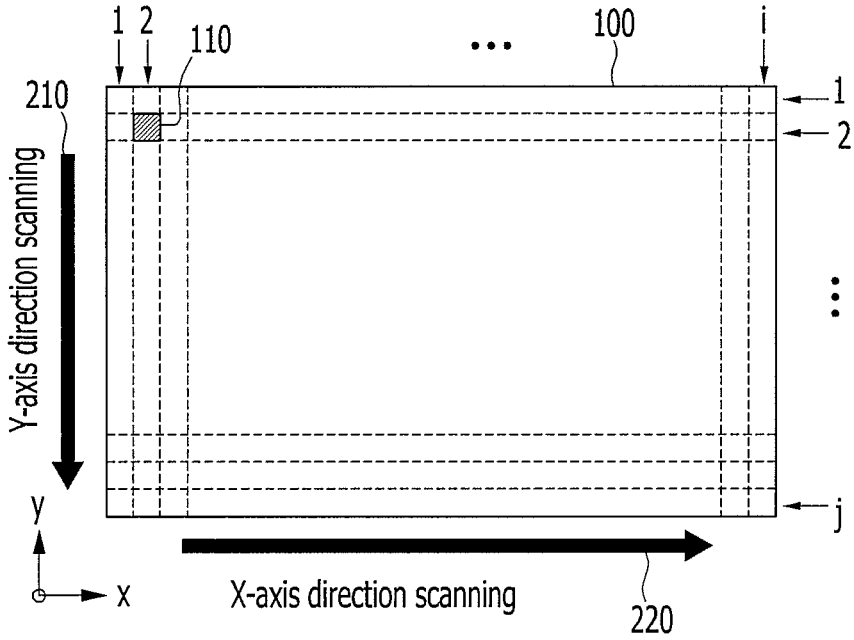
FIG. 2 shows an operation for sensing a contact point on a plasma display panel (PDP) according to an embodiment of the present invention.

FIG. 2 shows an operation for sensing a contact point on the PDP.

Referring to FIG. 2, the PDP 100 may include i*j discharge cells.

A plasma display device having a contact sensing function is a device that can sense a user contact point and display the contact point on a PDP according to an embodiment of the present invention. The plasma display device that can sense the contact point may be used as an electronic blackboard and the like. In a PDP used as an electronic blackboard, an address electrode driving operation may be performed in X and Y directions so as to sense a user contact point. A scan operation in the X-axis direction may be performed from the left to right direction (i.e., the direction of 220), and a scan operation in the Y-axis direction may be performed from the top to bottom direction (i.e., the direction of 210).

Figure 3:
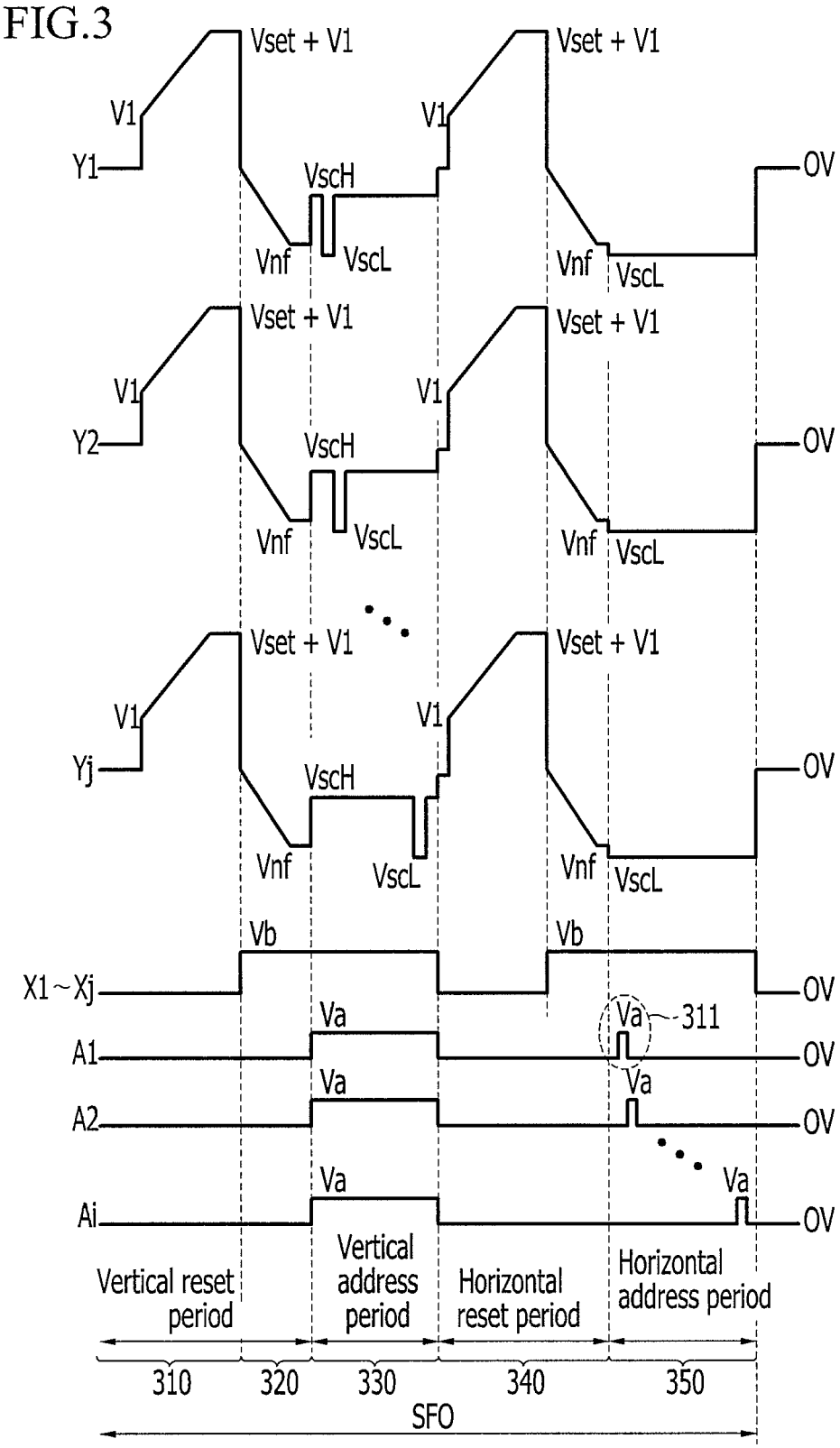
FIG. 3 shows driving waveforms of the plasma display device according to an exemplary embodiment of the present invention.

FIG. 3 shows driving waveforms of the plasma display device according to an exemplary embodiment.

Referring to FIG. 3, a sensing subfield (e.g., SF0) includes vertical reset periods 310 and 320, a vertical address period 330, a horizontal reset period 340, and a horizontal address period 350.

In the vertical reset period 310, the drivers 300, 400, and 500 apply reset waveforms to the A electrodes A1 to Ai, the Y electrodes Y1 to Yj, and the X electrodes X1 to Xj to reset the plurality of discharge cells 110.

In the vertical address period, while the sustain electrode driver 500 applies a Vb voltage to the plurality of X electrodes X1 to Xj and the address electrode driver 300 applies a Va voltage to the plurality of A electrodes A1 to Ai, the scan electrode driver 400 sequentially applies a scan pulse having a VscL voltage to the plurality of Y electrodes Y1 to Yj. A voltage higher than the VscL voltage, for example a VscH voltage, is applied to a Y electrode to which the scan pulse is not applied. As described with reference to FIG. 3, since an address discharge occurs between the A electrode applied with the Va voltage and the Y electrode applied with VscL voltage in a discharge cell formed by the A electrode and the Y electrode, an address discharge occurs in a plurality of discharge cells 110 defined by each of the Y electrodes whenever the VscL voltage is applied to the corresponding Y electrode. That is, a location of a discharge cell that emits light is changed in the Y-axis direction.

When a user contacts or approaches a surface of the PDP 100 with the optical sensor 600, the optical sensor 600 senses light emitted from a discharge cell in an area to which the optical sensor 600 contacts (or approaches) and transmits the sensing signal SEN to the controller 200. That is, the controller 200 performs an address electrode driving operation in the Y-axis direction in the vertical address period 330, and accordingly, the optical sensor 600 can determine a location in the Y-axis direction (i.e., Y-axis coordinate) of the contact or approach area.

In the horizontal reset period 340, the drivers 300, 400, and 500 apply reset waveforms to the A electrodes A1 to Ai, the Y electrodes Y1 to Yj, and the X electrodes X1 to Xj to re-reset the plurality of discharge cells 110.

In the horizontal address period 350, while the scan electrode driver 400 applies the VscL voltage to the plurality of Y electrodes Y1 to Yj and the sustain electrode driver 500 applies the Vb voltage to the plurality of X electrodes X1 to Xj, the address electrode driver 300 sequentially applies an address pulse having the Va voltage to the plurality of A electrodes A1 to Ai. Then, whenever the Va voltage is applied to each of the A electrodes, an address discharge occurs between the A and Y electrodes in a plurality of discharge cells 110 defined by the corresponding A electrode. That is, a location of a discharge cell that emits light is changed in the X-axis direction.

The optical sensor 600 senses light emitted from a discharge cell 110 in an area at which the optical sensor 600 contacts or approaches, and transmits a sensing signal SEN to the controller 200. That is, the controller 200 performs an address electrode driving operation in the X-axis direction in the horizontal address period 350, and accordingly, the optical sensor 600 can determine a location of the contact or approach area in the X-axis direction.

Then, the controller 200 can determine a location (i.e., coordinate) of the contact or approach area of the optical sensor 600 based on the Y coordinate determined in the vertical address period and the X coordinate determined in the horizontal address period.

In FIG. 3, since the X electrode is applied with the Vb voltage and the Y electrode is applied with the VscH voltage before the discharge occurs in the vertical address period 330, a potential difference Exy1 between the X and Y electrodes can be obtained as given in Equation 1. Here, since the X electrode is applied with the Vb voltage and the Y electrode is applied with the VscL voltage before the discharge occurs in the horizontal address period, a potential difference Exy2 between the X and Y electrodes can be obtained as given in Equation 2. Hereinafter, Vwxy denotes a potential difference formed by wall charges formed between the X electrode and the Y electrode. In addition, a Vwxy voltage denotes a voltage value (i.e., a potential difference formed by the wall charges) of the X electrode, measured with reference to the Y electrode.

$$Exy1=Vb-VscH+Vwxy \quad \text{Equation 1}$$

In Equation 1, Vwxy denotes a potential difference formed by wall charges formed between the X and Y electrodes at the finishing point of the vertical reset periods 310 and 320.

$$Exy2=Vb-VscL+Vwxy \quad \text{Equation 2}$$

In Equation 2, Vwxy denotes a potential difference formed by wall charges formed between the X and Y electrodes after termination of the horizontal reset period 340.

Since the VscL voltage is lower than the VscH voltage, the potential difference Exy2 between the X and Y electrodes in the horizontal address period 350 is greater than the potential difference Exy1 between the A and Y electrodes in the vertical address period 330. Therefore, negative charges formed on the Y electrode by the potential difference Exy2 between the X and Y electrodes in the horizontal address period 350 may be lost. However, the address discharge occurs between the A electrode and the Y electrode. In this case, the A electrode functions as an anode and the Y electrode functions as a cathode, and therefore the address discharge may be weak when the negative charges are lost on the Y electrode.

Accordingly, light output is weakened as time passes in the horizontal address period so that the detected X coordinate of the contact location may not be accurate. For example, assume that i discharge cells are arranged in the X-axis direction and i address pulses (signal waveforms input through the address electrodes) 311 each having the Va voltage are respectively applied to i address electrodes A1, A2, . . . and Ai that correspond to the i discharge cell lines in the horizontal address period 350. Under this assumption, light output is decreased in discharge cells (in the i-th line) that are applied with the address pulses late in the horizontal address period so that X coordinate sensing may not be accurately performed.

In the following description, an exemplary embodiment for accurate sensing of the X coordinate by preventing or reducing a decrease of the light output in the horizontal address period 350 will be described in further detail with reference to FIG. 4, FIG. 5, and FIG. 6.

Figure 4:
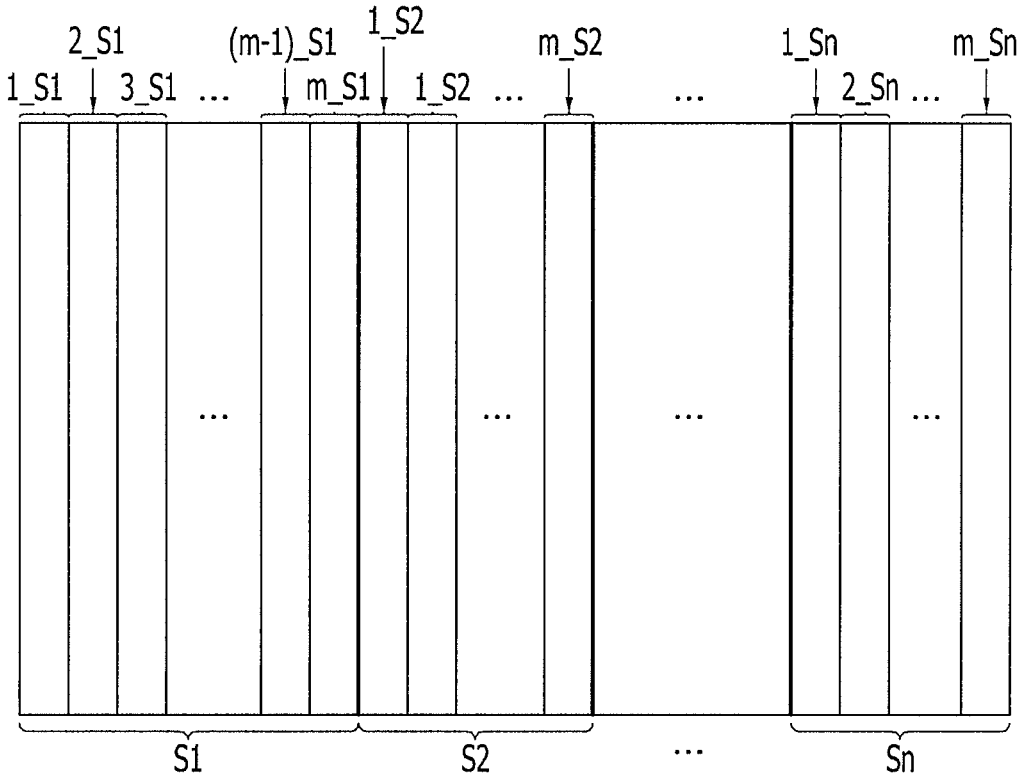
FIG. 4 illustrates a method of grouping address electrodes used in the plasma display device and a driving method of the plasma display device.

FIG. 4 is provided for describing a method for grouping of address electrodes used in a plasma display device according to the exemplary embodiment and the driving method thereof.

Referring to FIG. 4, the controller 200 logically groups i address electrodes into n groups S1 to Sn. Therefore, each of the n groups includes i/n address electrodes.

In addition, the controller 200 logically divides each of the groups into m sub-groups. For example, the first group S1 is divided into m sub-groups 1_S1, 2_S1, 3_S1, . . . (m−1)_S1, and m_S1. One sub-group includes i/(n*m) address electrodes.

Figure 5:
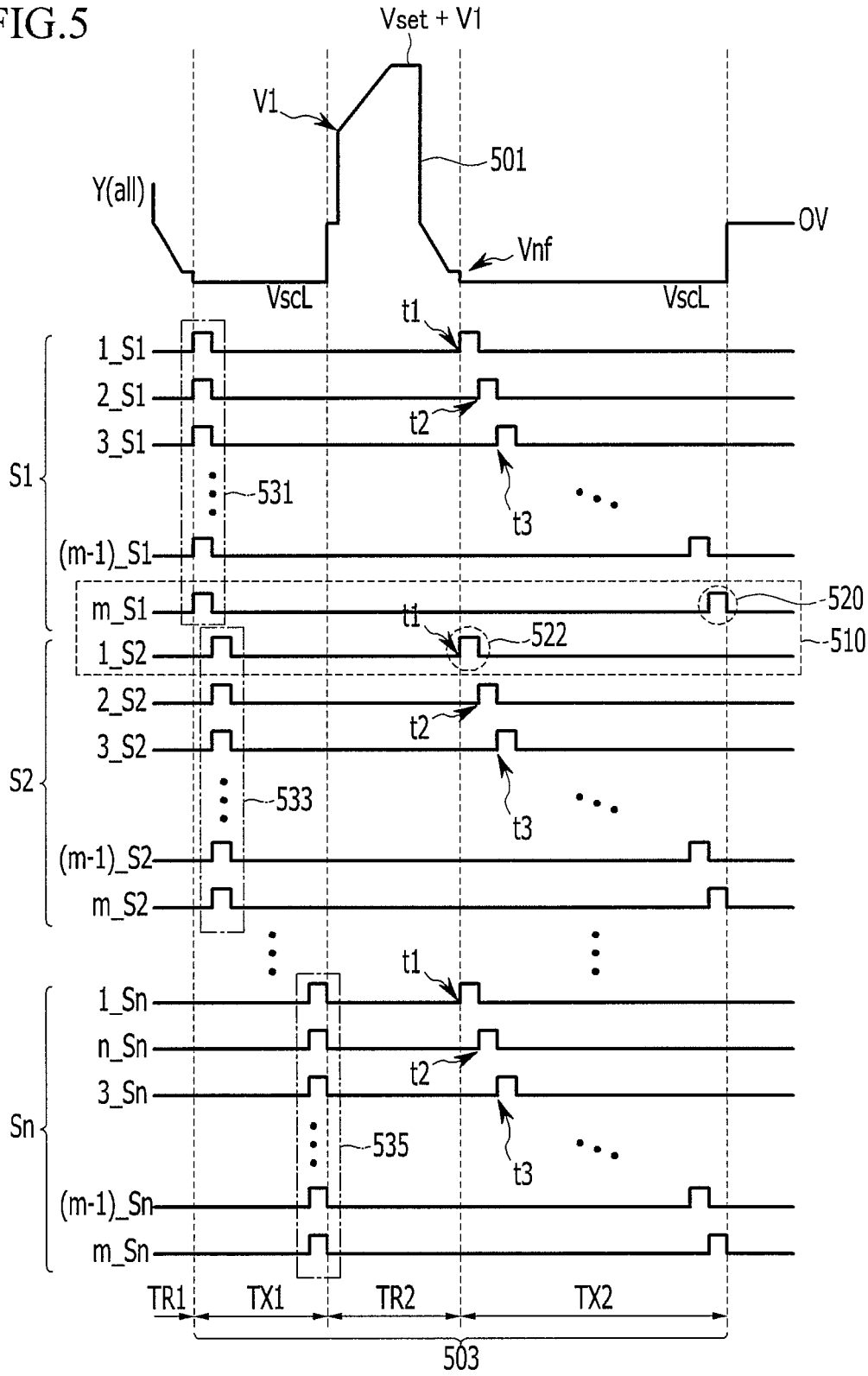
FIG. 5 illustrates the plasma display device and a driving method thereof according to the exemplary embodiment.

FIG. 5 is provided for describing a driving method of a plasma display device according to an exemplary embodiment, and a plasma display device using the same.

Compared to the driving waveforms of FIG. 3, driving waveforms of three periods TX1, TR2, and TX2 shown in FIG. 5 are performed instead of the driving waveforms in the horizontal address period 350 of FIG. 3 in a driving method of a plasma display device according to an exemplary embodiment, and a plasma display device using the same.

In the first period TX1, an address electrode driver 300 sequentially applies first pulses 531, 533, and 535 to the plurality of address electrode groups S1 to Sn. Address electrodes, in the number of i/n, included in the same group are applied with the same first pulse.

In addition, each of the first pulses applied in the first period TX1 may cause a discharge in the corresponding discharge cell, and therefore a reset operation is performed in the reset period TR2. The reset operation is the same as the reset operation in the horizontal reset period 340 of FIG. 3.

In the second period TX2, the address electrode driver 300 sequentially applies a second pulse to each of the plurality of sub-groups 1_S1, 2_S1, 3_S1, . . . , m−1_S1, m_S1/1_S2, 2_S2, 3_S2, . . . , m−1_S2, m_S2/1_Sn, 2_Sn, 3_Sn, . . . , m−1_Sn, and m_Sn. Address electrodes, in the number of i/(n*m), included in the same sub-group are applied with the same second pulse. The k-th sub-group in the respective groups are applied with the second pulse applied at the k-th time.

A controller 200 controls generation of the first and second pulses, as shown in FIG. 5. That is, the address electrode driver 300 receives control from the controller 200 and applies the first and second pulses to the plurality of address electrodes.

For example, when a time interval of the address pulse is 1.5 μs, n=m=4, and i=1920, the first period needs 1.5 μs*4=6 μs and the second period needs 1.5 μs*(1920/(4*4))=180 μs.

Here, the number of address electrodes included in each sub-group, that is, i/(n*m), may be decreased as resolution of the plasma display device is increased. This is because, since the same second pulse is applied to a single sub-group, definition of an image displayed on a PDP is increased as the number of scan lines applied with the same second pulse is decreased. Therefore, as the resolution of high-definition plasma display device is increased, the number (i.e., i/(n*m)) of address electrodes included in a sub-group may be decreased.

In a plasma display device having a contact sensing function, a user contact point may be shown over at least four address electrodes. This is because, compared with an interval (or spacing) between the address electrodes that is several micrometer to several millimeter, the minimum contact width of an optical sensor (e.g., a touch pencil, etc.) used by a user for contact with the PDP is greater than the interval.

Figure 6:
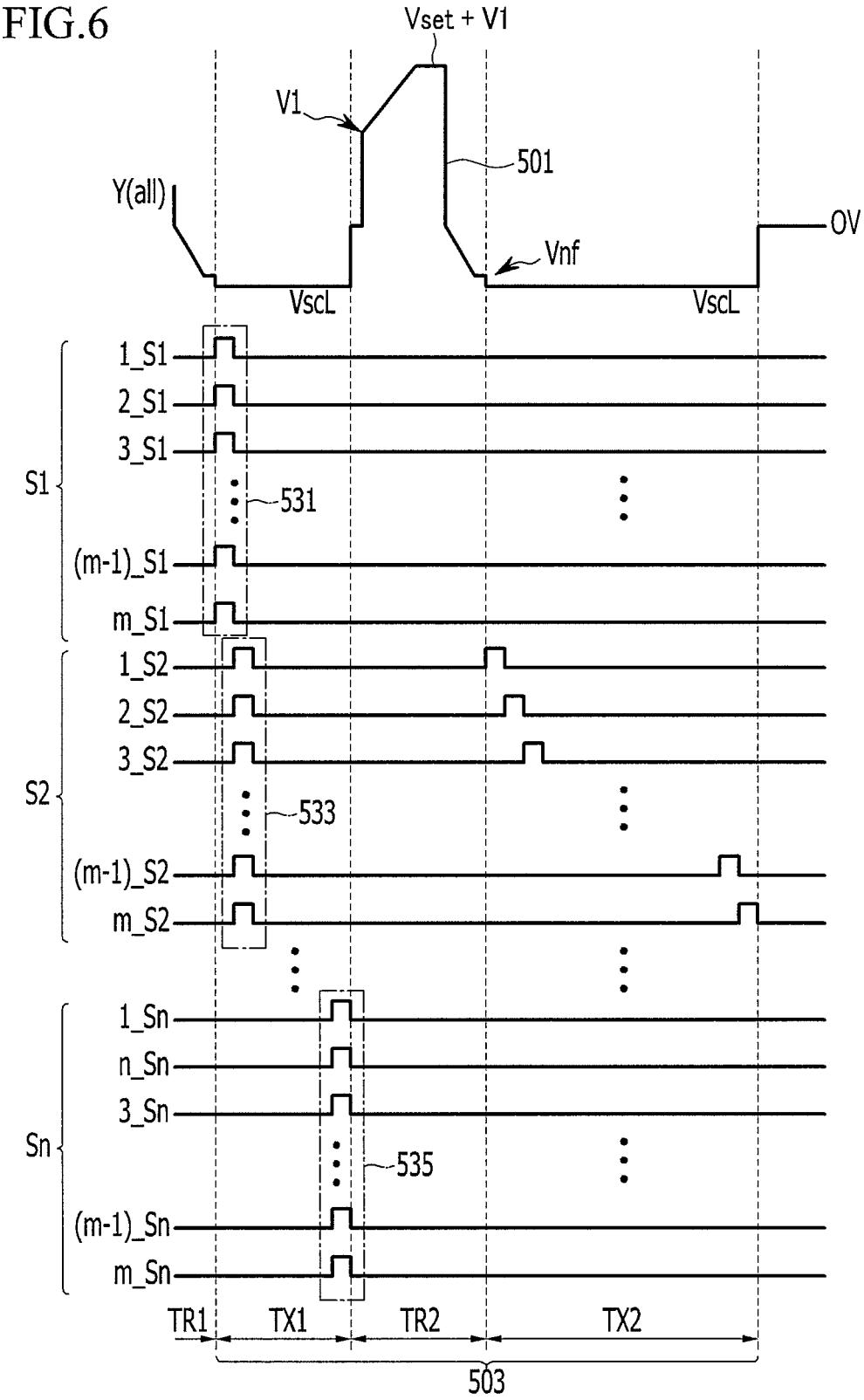
FIG. 6 illustrates a plasma display device and a driving method thereof according to another exemplary embodiment.

FIG. 6 is provided for describing a plasma display device according to another exemplary embodiment, and a driving method thereof.

Referring to FIG. 6, unlike the driving waveforms of FIG. 5, an address electrode driver 300 applies a second pulse to address electrodes included to a contact sensed group in a second period TX2. FIG. 6 exemplarily shows a case in which contact is sensed in the second group S2.

As shown in FIG. 1 and FIG. 3, a scan electrode driver 400 sequentially applies a third pulse to a plurality of scan electrodes (Y electrodes) in a vertical address period 330, that is, a period before a first period TX1.

A controller 200 determines to which group among the plurality of groups S1 to Sn a contact sensed point (or location) on a PDP included in the plasma display device is included. The controller 200 determines a contact location in a first direction (i.e., X-axis direction) from light generated during the first period TX1 and light generated during the second period TX2, and determines a contact location in a second direction (i.e., Y-axis direction) from light generated during a third period (i.e., vertical address period 330). The contact location corresponds to a location of an optical sensor 600.

An address electrode driver 300 sequentially applies a second pulse to each of first to m-th sub-groups 1_S2, 2_S2, 3_S2, m−1_S2, and m_S2 included in the second group S2 where contact is sensed. In addition, groups where no contact is sensed are not applied with the second pulse.

Figure 7:
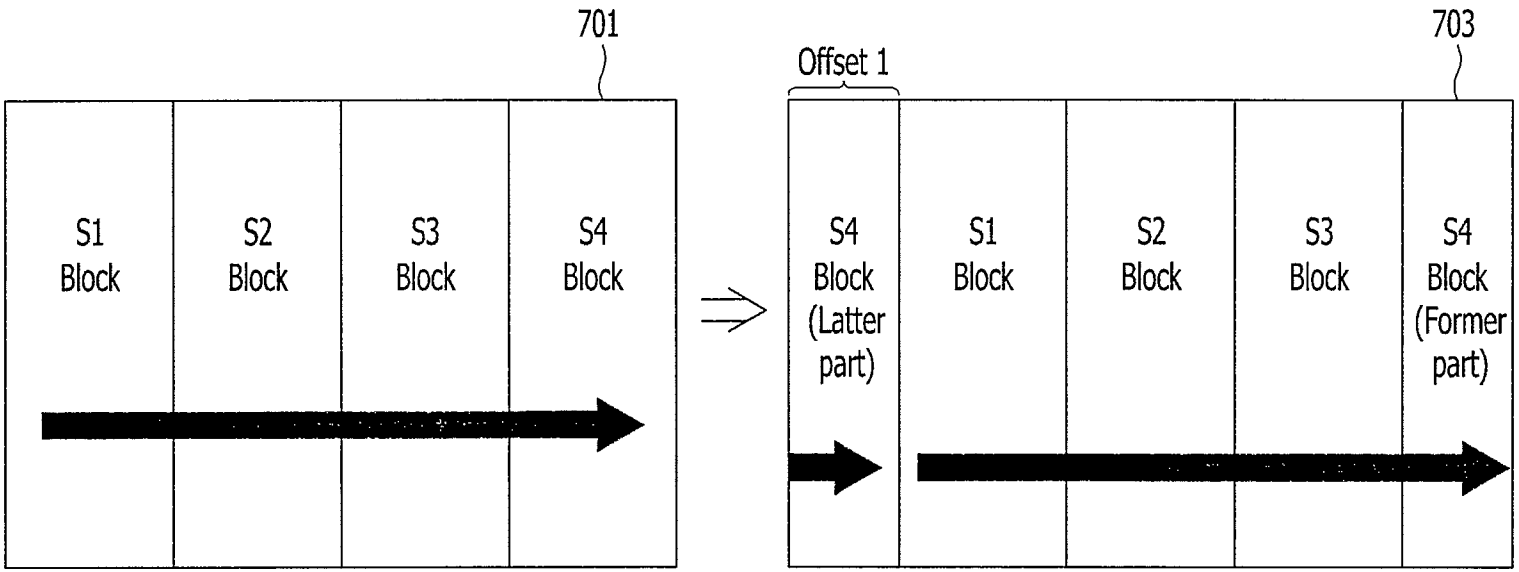
FIG. 7 illustrates a plasma display device that can prevent a location coordinate recognition error according to another exemplary embodiment, and a driving method thereof.

FIG. 7 is provided for describing a plasma display device that can prevent or reduce a location coordinate recognition error according to another exemplary embodiment, and a driving method thereof.

Referring to FIG. 5, light is not continuously generated at boundaries between groups. When light is continuously generated, it is generally determined that the address electrode driving operation is normally performed. Therefore, when light is discontinuously emitted from adjacent discharge cell lines, an accurate contact point may not be recognized. Referring to FIG. 5, in a boundary 510 between the first and second groups S1 and S2, lights, respectively generated by the application of the pulses 520 and 522, are not continuously generated (in one direction) from the adjacent cell lines.

Continued from the second pulse application process, a location coordinate of frame data indicating a contact sensed location on a PDP is scanned. An address electrode for scanning the frame data is driven by using the first and second pulses. In addition, the controller 200 determines whether location coordinate recognition errors occur in boundaries of the n groups S1 to Sn. When it is determined that errors have occurred, the controller 200 shifts a start point of each of the plurality of groups S1 to Sn by an offset offset1 that is equal to f address electrode intervals. Here, the address electrode interval may be a horizontal distance (the shortest distance) between two adjacent address electrodes. That is, the start point of each of the first to n-th groups is shifted by the offset offset1 for grouping the grouping as in 701 and 703 in FIG. 7.

Here, f is an integer greater than 1 and less than i/n. f may be a half of an interval of one group.

In addition, the controller 200 re-inputs previous frame data to the PDP. With reference to start points of the groups, shifted by a first offset, the first and second pulse application operations described with reference to FIG. 5 are repeated. Here, the second pulse application operation is repeated for each of the sub-groups of which start points are newly set as in grouping 703.

As described above, when the coordinate recognition errors occur in the boundaries between groups, start points of the groups and sub-groups are changed and the first and second pulse application processes are repeated to thereby accurately recognize a coordinate of the error-occurred boundary part.

Figure 8:
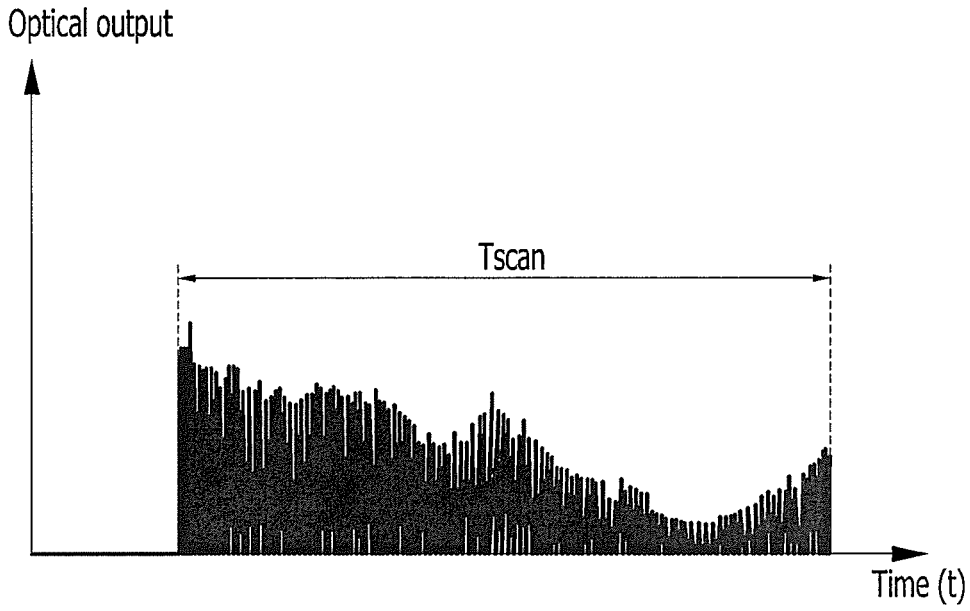
FIG. 8 shows an optical output decrease during the horizontal address period of FIG. 3.

FIG. 8 shows an optical output decrease during the horizontal address period of FIG. 3.

As described with reference to FIG. 3, when the address electrode driving operation is proceeding in the X-axis direction, the optical output generated from the discharge cells is decreased as time passes. In FIG. 8, Tscan denotes the horizontal address period of FIG. 3. Therefore, an optical output generated in the latter part of an address time (i.e., period of 350) is significantly decreased, and an X coordinate of a user contact point may not be accurately recognized with the decreased optical output.

For reference, when 1920 light emitting cell lines and 1920 address electrodes are provided in the X-axis direction and one address pulse width is 1.5 us, a time of 1920*1.5 us=2880 us is required for finishing the address electrode driving operation in the X-axis direction by using the address driving waveforms of FIG. 3.

Figure 9:
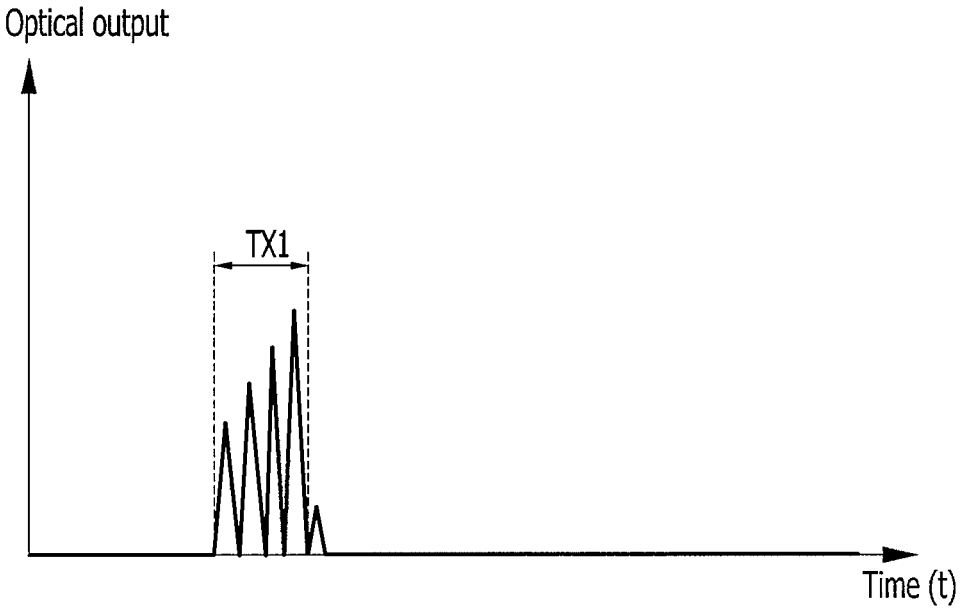
FIG. 9 shows an optical output generated in a case in which a horizontal address electrode operation is performed according to the plasma display device and the driving method thereof according to an exemplary embodiment.

FIG. 9 shows an optical output generated when the horizontal address electrode driving operation is performed according to the driving method and the plasma display device according to an exemplary embodiment.

Referring to FIG. 9, an optical output generated during the first period TX1 according to the first pulse of FIG. 5 or FIG. 6 is shown. In addition, FIG. 9 shows an optical output generated when i=1920 and n=m=4. Since n=4, the optical output is generated four times when four of the first pulses are sequentially applied each of the first and second groups. As shown in the drawing, the optical output is generated without a decrease of output.

Figure 10:
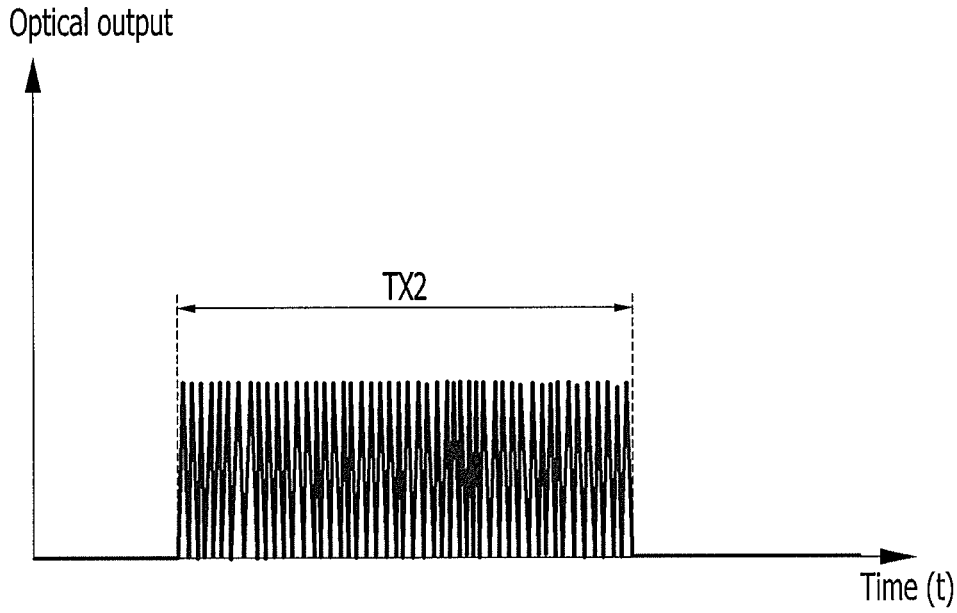
FIG. 10 shows an optical output generated in a case in which a horizontal address electrode operation is performed according to the plasma display device and the driving method thereof according to an exemplary embodiment.

FIG. 10 shows an optical output generated when the horizontal address electrode driving operation according to the driving method and the plasma display device according to the exemplary embodiment is used.

As in FIG. 9, FIG. 10 shows an optical output generated when i=1920 and n=m=4, and the optical output is generated during the second period TX2 according to the second pulse application. When i=1920 and n=m=4, the second pulse is applied 120 times, and when a second pulse interval is 1.5 us, the second period TX2 becomes 1.5 us*(1920/(4*4))=180 us. As shown in the drawing, the optical output is generated without a decrease of output in the second period. Therefore, the coordinate recognition error problem due to a decrease of the optical output can be solved, and accordingly, accurate coordinate recognition can be performed. In addition, addressing time can be shortened compared to the case of using known address pulse application method, and accordingly, operation speed of the plasma display device can be increased.

While this disclosure has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A driving method of a plasma display device comprising a plurality of address electrodes extending in a first direction, the method comprising:

grouping the plurality of address electrodes into a plurality of groups;

logically dividing each of the plurality of groups into a plurality of sub-groups;

during a first period, sequentially applying a first pulse to the plurality of groups, the first pulse being concurrently applied to the plurality of sub-groups; and during a second period following the first period, sequentially applying a second pulse to the plurality of sub-groups included in at least one of the plurality of groups, wherein the first and second periods are address periods for sensing in a second direction crossing the first direction.

2. The driving method of claim 1, wherein the sequential applying of the second pulse comprises sequentially applying the second pulse to the plurality of sub-groups included in each of the plurality of groups.

3. The driving method of claim 2, wherein the sequential applying of the second pulse comprises concurrently applying the second pulse to one of the sub-groups included in a first group and one of the sub-groups included in a second group from among the plurality of groups.

4. The driving method of claim 2, wherein a k-th sub-group of each of the plurality of groups is applied with the second pulse applied at a k-th time, wherein k is an integer that is greater than 1 and less than the number of the plurality of sub-groups.

5. The driving method of claim 1, further comprising determining a group that corresponds to a contact location among the plurality of groups from light generated during the first period, wherein the sequential applying of the second pulse comprises sequentially applying the second pulse to the plurality of sub-groups included in the group corresponding to the contact location.

6. The driving method of claim 1, wherein the plasma display device further comprises a plurality of scan electrodes extending in the second direction, and the driving method further comprises sequentially applying a third pulse to the plurality of scan electrodes during a third period that precedes the first period, and the third period is a vertical address period for sensing.

7. The driving method of claim 6, further comprising:

determining a contact location in the first direction from light generated during the first period and light generated during the second period; and determining the contact location in the second direction from light generated during the third period.

8. The driving method of claim 7, wherein the lights generated during the first, second, and third periods are sensed through an optical sensor that contacts or approaches the plasma display device, and the contact location corresponds to a location of the optical sensor.

9. The driving method of claim 1, further comprising:

shifting a start point of each of the plurality of groups by an offset interval;

during a third period following the second period, sequentially applying a third pulse to the plurality of groups; and during a fourth period following the third period, sequentially applying a fourth pulse to the plurality of sub-groups included in each of the plurality groups, wherein the offset interval is an interval corresponds to at least one of the address electrodes.

10. The driving method of claim 9, wherein the offset interval is greater than the interval corresponding to one address electrode and less than the number of a plurality of address electrodes included in the at least one of the plurality of groups.

11. The driving method of claim 9, further comprising:

sensing a contact location in the first direction by using light generated during the first period and light generated during the second period; and determining whether or not an error has occurred in the sensing, wherein when the sensing error has occurred, the third and fourth periods are performed.

12. A driving method of a plasma display device comprising a plurality of address electrodes extending in a first direction and a plurality of scan electrodes extending in a second direction that crosses the first direction, the method comprising:

grouping the plurality of address electrodes into a plurality of groups;

logically dividing each of the plurality of groups into a plurality of sub-groups;

during a first period, sequentially applying a first pulse to the plurality of scan electrodes;

during a second period following the first period, sequentially applying a second pulse to the plurality of groups;

during a third period following the second period, sequentially applying a third pulse to the plurality of sub-groups included in at least one of the plurality of groups;

sensing light generated during the first, second, and third periods through an optical sensor;

determining a location of the optical sensor in the first direction from the light sensed during the first period; and determining a location of the optical sensor in the second direction in the second period from a combination of the light sensed during the second period and the light sensed during the third period, wherein the first period is an address period for sensing in the first direction, and the second and third periods are address periods for sensing in the second direction.

13. A plasma display device comprising:

a plurality of address electrodes extending in a first direction;

a controller for grouping the plurality of address electrodes into a plurality of groups and dividing each of the plurality of groups into a plurality of sub-groups; and a first driver for sequentially applying a first pulse by a group unit to the plurality of groups during a first period and sequentially applying a second pulse by a sub-group unit to a plurality of sub-groups included in at least one of the plurality of groups during a second period following the first period in response to a control signal of the controller, wherein the first and second periods are address periods for sensing in a second direction crossing the first direction.

14. The plasma display device of claim 13, further comprising:

a plurality of scan electrodes extending in the second direction that crosses the first direction; and a second driver for sequentially applying a third pulse to the plurality of scan electrodes during a third period preceding the first period in response to the control signal of the controller, wherein the third period is an address period for sensing in the first direction.

15. The plasma display device of claim 14, wherein the controller is configured to determine a contact location in the second direction from light generated during the first period and light generated during the second period, and to determine the contact location in the first direction from light generated during the third period.

16. The plasma display device of claim 14, wherein the second driver is configured to sequentially apply a fourth pulse to the plurality of scan electrodes during a fourth period following the third period, and the first driver is configured to apply a fifth pulse to a discharge cell to be selected from a plurality of discharge cells defined by scan electrodes to which the fourth pulse is applied among the plurality of scan electrode and the plurality of address electrodes.

17. The plasma display device of claim 13, wherein the controller is configured to shift a start point of each of the plurality of groups by an offset interval, the first driver is configured to sequentially apply a third pulse to the plurality of groups during a third period and a fourth pulse to the plurality of sub-groups included in each of the plurality groups during a fourth period, and the offset interval corresponds to at least one address electrode.

18. The plasma display device of claim 17, wherein the controller is configured to sense a contact location in the second direction by using lights generated during the first and second periods, to determine whether or not a sensing error occurred, and to control to perform the third and fourth periods when the sensing error occurred.

* * * * *